US006227369B1

(12) United States Patent
Glassman

(10) Patent No.: US 6,227,369 B1
(45) Date of Patent: May 8, 2001

(54) CLAMSHELL PACKAGE INCLUDING BOTH PERMANENT AND RESEALABLE FASTENING STRUCTURE

(75) Inventor: Ellen Tave Glassman, Haworth, NJ (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/430,571

(22) Filed: Oct. 29, 1999

(51) Int. Cl.[7] ..... B65D 73/00
(52) U.S. Cl. ..... 206/469; 220/4.23
(58) Field of Search ..... 206/461, 467, 206/469, 470, 807; 220/4.23

(56) References Cited

U.S. PATENT DOCUMENTS

| | | | |
|---|---|---|---|
| D. 219,429 | 12/1970 | Hill et al. . | |
| D. 238,674 | 2/1976 | Luodthe . | |
| D. 244,775 | 6/1977 | Wilson . | |
| D. 252,797 | 9/1979 | Fuller . | |
| D. 267,394 | 12/1982 | Liptak et al. . | |
| D. 273,565 | 4/1984 | Driskell et al. . | |
| D. 275,835 | 10/1984 | Borst . | |
| D. 313,753 | 1/1991 | Nagasaka . | |
| D. 332,216 | 1/1993 | Lee et al. . | |
| D. 332,398 | 1/1993 | Lee et al. . | |
| D. 348,391 | 7/1994 | Ichikawa et al. . | |
| D. 349,457 | 8/1994 | Nottingham et al. . | |
| D. 365,753 | 1/1996 | Sibbio . | |
| D. 400,096 | 10/1998 | Lee . | |
| 2,584,095 | 1/1952 | Slaughter . | |
| 3,025,958 | 3/1962 | Snape . | |
| 3,111,220 | 11/1963 | Bostrom . | |
| 3,192,681 | 7/1965 | Greenbaum . | |
| 3,375,921 | 4/1968 | Ligon . | |
| 3,463,309 | 8/1969 | Szostek . | |
| 3,497,059 | 2/1970 | Watts, Jr. . | |
| 3,685,649 | 8/1972 | Diehl . | |
| 3,747,830 | 7/1973 | Goldman . | |
| 3,835,224 * | 9/1974 | Peters | 206/467 X |
| 3,927,762 | 12/1975 | Zdarsky et al. . | |
| 4,091,927 | 5/1978 | Lunsford . | |
| 4,161,246 | 7/1979 | Tanaka . | |

(List continued on next page.)

OTHER PUBLICATIONS

Photography of various prior art packages displayed on sale in retail stores, collectively consisting of eight (8) pages containing a total of twenty–seven (27) separate photographs.

*Primary Examiner*—Bryon P. Gehman
(74) *Attorney, Agent, or Firm*—Wood, Herron & Evans, L.L.P.

(57) ABSTRACT

A clamshell package for holding and displaying a product including first and second outer clamshell members each having three dimensionally shaped pocket areas for holding a portion of the product. The clamshell members also each include respective sealing portions which may be sealed together in a permanent manner. The package further includes selectively engageable fastening structure disposed on the first and second outer clamshell members generally adjacent the first and second sealing portions. When the sealing portions are removed, such as by cutting off the sealing portions, the selectively engageable fastening structure may be used to allow subsequent selective access to the product. A hinge portion may also be provided and may be formed from a pair of the sealing portions of the clamshell members to allow hinged movement of the clamshell members after other sealing portions have been removed by the user.

26 Claims, 5 Drawing Sheets

U.S. PATENT DOCUMENTS

| | | | | |
|---|---|---|---|---|
| 4,200,193 | | 4/1980 | Boyle . | |
| 4,202,464 | | 5/1980 | Mohs et al. . | |
| 4,210,246 | | 7/1980 | Kuchenbecker . | |
| 4,213,531 | | 7/1980 | Rae . | |
| 4,261,462 | | 4/1981 | Wysocki . | |
| 4,300,682 | | 11/1981 | Kuckenbecker . | |
| 4,356,919 | | 11/1982 | Matney . | |
| 4,408,693 | | 10/1983 | Brewaeys et al. . | |
| 4,423,811 | | 1/1984 | Knapp . | |
| 4,453,629 | | 6/1984 | Goldberg . | |
| 4,453,666 | | 6/1984 | Gordon . | |
| 4,456,124 | | 6/1984 | Kay et al. . | |
| 4,466,534 | | 8/1984 | Dunn . | |
| 4,494,650 | | 1/1985 | Cullen . | |
| 4,499,353 | | 2/1985 | Shields . | |
| 4,512,474 | | 4/1985 | Harding . | |
| 4,669,610 | | 6/1987 | Lindsey et al. . | |
| 4,687,129 | | 8/1987 | Cugley . | |
| 4,699,291 | * | 10/1987 | Prais et al. | 206/467 X |
| 4,724,964 | | 2/1988 | Hernandez . | |
| 4,732,273 | | 3/1988 | DeMarco . | |
| 4,739,883 | | 4/1988 | Mohs et al. . | |
| 4,742,912 | | 5/1988 | Lee . | |
| 4,753,340 | | 6/1988 | Blakeman et al. . | |
| 4,804,984 | | 2/1989 | Heuer et al. . | |
| 4,896,770 | | 1/1990 | Calcerano et al. . | |
| 4,899,877 | | 2/1990 | Kiernan . | |
| 4,944,435 | | 7/1990 | Lee . | |
| 4,986,438 | | 1/1991 | Borst . | |
| 4,989,548 | | 2/1991 | Short et al. . | |
| 5,016,241 | | 5/1991 | Lee et al. . | |
| 5,129,516 | | 7/1992 | Theros . | |
| 5,129,517 | | 7/1992 | Hustad . | |
| 5,143,215 | | 9/1992 | Hartley et al. . | |
| 5,154,293 | | 10/1992 | Gould . | |
| 5,209,354 | | 5/1993 | Thornhill et al. . | |
| 5,297,679 | | 3/1994 | Rondone et al. . | |
| 5,311,990 | | 5/1994 | Kalinski . | |
| 5,435,447 | | 7/1995 | Weatherford et al. . | |
| 5,443,154 | * | 8/1995 | Hustad et al. | 206/469 X |
| 5,447,232 | | 9/1995 | Chow . | |
| 5,549,204 | * | 8/1996 | Toren | 220/4.23 X |
| 5,582,317 | | 12/1996 | Wermund . | |
| 5,595,295 | | 1/1997 | Lin . | |
| 5,669,549 | | 9/1997 | Robertson . | |
| 5,788,105 | | 8/1998 | Foos . | |
| 5,849,378 | | 12/1998 | Gask . | |
| 5,865,013 | | 2/1999 | Jackson . | |
| 6,053,321 | * | 4/2000 | Kayser | 206/470 |
| 6,065,589 | * | 5/2000 | Ouwens | 220/4.23 X |

* cited by examiner

CLAMSHELL PACKAGE INCLUDING BOTH PERMANENT AND RESEALABLE FASTENING STRUCTURE

FIELD OF THE INVENTION

The present invention generally relates to packages for containing and displaying products and, more specifically, to so-called clamshell packages having two halves typically formed of plastic and sealed together prior to purchase use by a retail consumer.

BACKGROUND OF THE INVENTION

Clamshell or blister pack packaging is a very popular type of packaging for many consumer products, including electrical and electronic products, such as portable compact disc players, cassette recorders or players and other portable audio or video products. Quite often, the clamshell packaging is designed to be theft resistant while also enabling the product design and features to be clearly displayed to the consumer at the retail level. However, while achieving these objectives, this type of packaging can be very difficult to open for young and old consumers alike.

Typically, the consumer must use scissors, a knife or another device with a sharp cutting edge to open the package and, even in such cases, many packages can still be difficult to open.

It would therefore be desirable to provide a clamshell package that is both permanently sealable, for example, for shipment and retail display purposes and to provide theft resistance, but which is subsequently usable in a resealable manner by the consumer. It would further be desirable to provide a clamshell package that is easier for consumers to open than previous clamshell package and blister pack designs.

SUMMARY OF THE INVENTION

The present invention generally provides a clamshell package for holding and displaying a product in which first and second outer clamshell members may be initially permanently sealed together and, subsequently, affixed to one another by a consumer in a selectively engageable manner to allow selective access to the product. In one preferred configuration, the first outer clamshell member includes a first three dimensional pocket area for holding a portion of the product and a second outer clamshell member having a second three dimensional pocket area for holding another portion of the product. Each of the first and second outer clamshell members include a removable sealing portion with the removable sealing portions adapted to be permanently sealed together to hold the product between the clamshell members. In further accordance with the invention, selectively engageble fastening structure is disposed on the first and second outer clamshell members generally adjacent the first and second sealing portions when the sealing portions are sealed to each other. The first and second sealing portions may be removed such that the consumer may then selectively engage and disengage the fastening structure to allow selective access to the product and reuse of the clamshell package.

Although other sealing methods may be used, one preferred manner is to heat seal or ultrasonically seal the sealing portions together, while another option may be to adhesively secure the sealing portions together. Each method results in a permanent connection between the clamshell members. The selectively engageable fastening structure may also have many different configurations. In general, it is desirable to provide fastening structure of the type enabling a simple snap-fit or frictional fit of the two clamshell members together. For example, the fastening structure may comprise at least one bead disposed along a peripheral portion of one of the first and second outer clamshell members and a mating recess disposed along a corresponding peripheral portion of the other clamshell member. One or more beads may then be selectively received in a corresponding one or more recesses to selectively open and close the clamshell members. Optionally, the clamshell members may simply have respective inner and outer surfaces that nest together in either a snap-fit or frictional fitting manner. Other connection methods and structures are possible as well.

In one embodiment of the invention, a plurality of beads are disposed about respective peripheral portions of one of the outer clamshell members and a corresponding plurality of mating recesses are disposed about respective peripheral portions of the other clamshell member. This can allow, for example, the use of a hinge portion between two of the beads and recesses such that the consumer may open and close the clamshells using the hinge portion and engage the beads and recesses with one another to close the clamshell. Other configurations using a hinge structure and one or more selectively engageable fastening structures are within the scope of this invention as well. In the preferred embodiment, the hinge portion is formed at least in part by respective sealing portions of the first and second outer clamshell members and is disposed along an upper peripheral portion of the clamshell members. One or more cutting indicator lines may be disposed adjacent at least one of the first and second sealing portions so that a consumer may use scissors or other means to remove the sealing portions. This cutting indicator line may comprise a series of perforations and the same series of perforations may be used as a hinge line when a hinge portion is utilized in the clamshell package. In the preferred embodiment, the first and second sealing portions are disposed peripherally outside of the fastening structure and the cutting indicator line or lines are disposed between the sealing portions and the selectively engageable fastening structure.

In one embodiment, three separate pairs of sealing portions are utilized around the periphery of the clamshell members, with one of the sealing portions capable of being left in place by the consumer to provide the hinge portion. In another embodiment, the sealing portion extends around at least substantially the entire periphery without designating a specific hinge portion to be optionally left intact by the consumer. In each case, the sealing portions are easily removable by the consumer, for example, with a pair of scissors, to leave the selectively engageable fastening structure intact to enable further, selective access to the product by the consumer or others.

These and other objects, advantages and features of the invention will become more readily apparent to those of ordinary skill in the art upon review of the following detailed description of the preferred embodiments, taken in conjunction with the accompanying drawings.

DETAILED DESCRIPTION OF THE PREFERRED EMBODIMENTS

Figure 1:
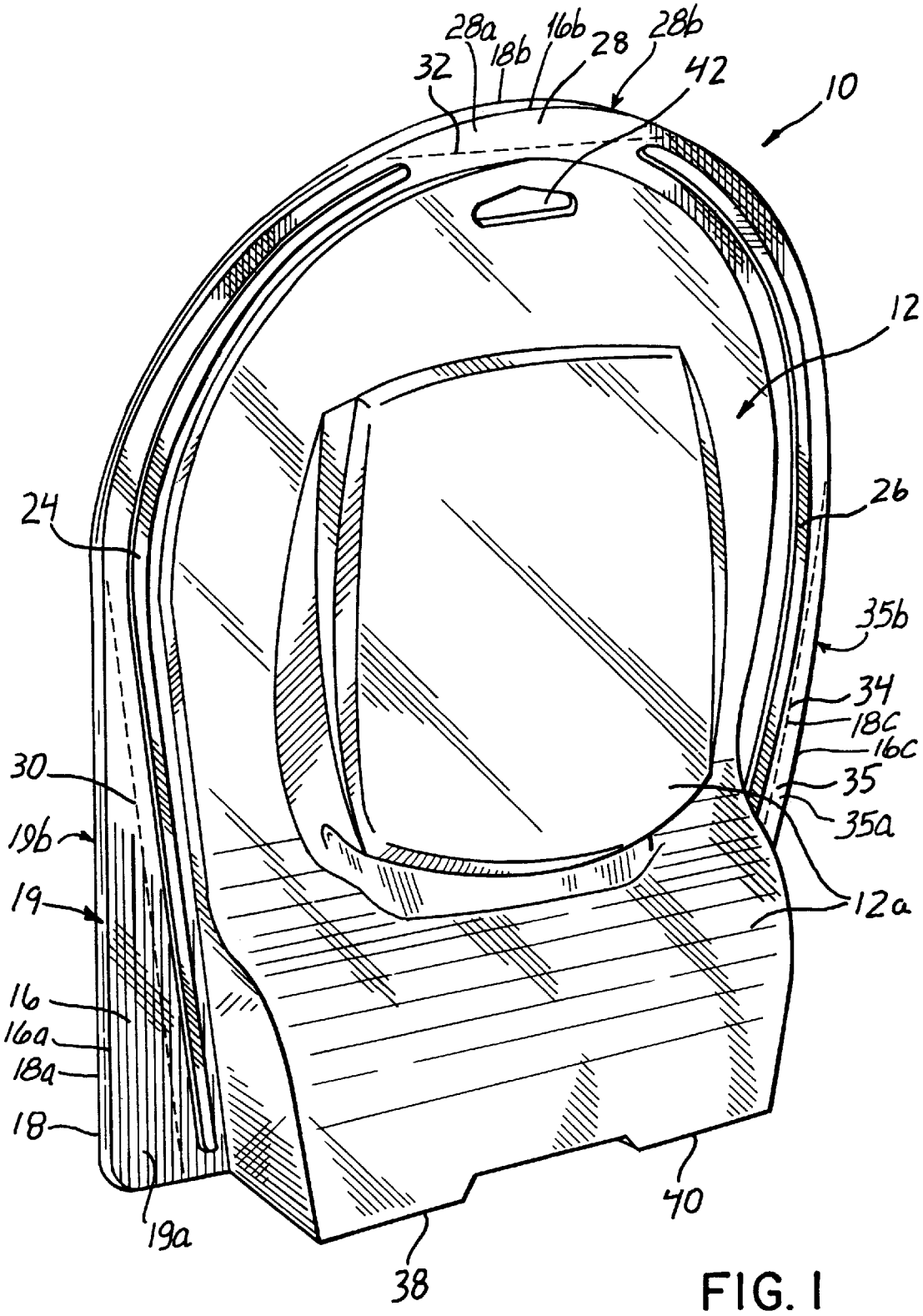
FIG. 1 is a perspective view of a clamshell package constructed in accordance with one embodiment of the invention.
Figure 2:
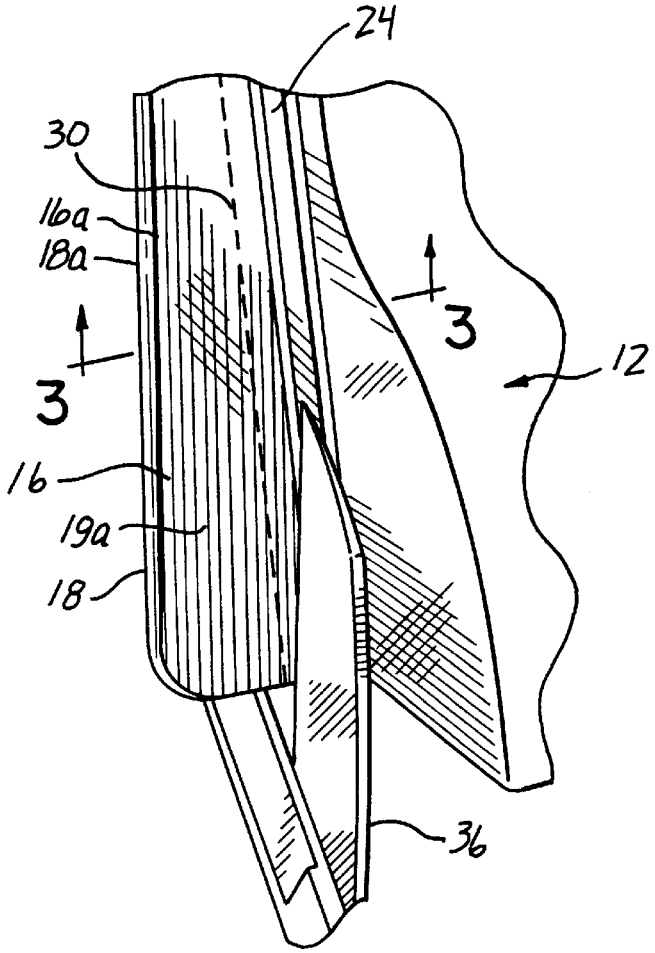
FIG. 2 is an enlarged perspective view of a fragmented corner of the package being cut with scissors.
Figure 3:
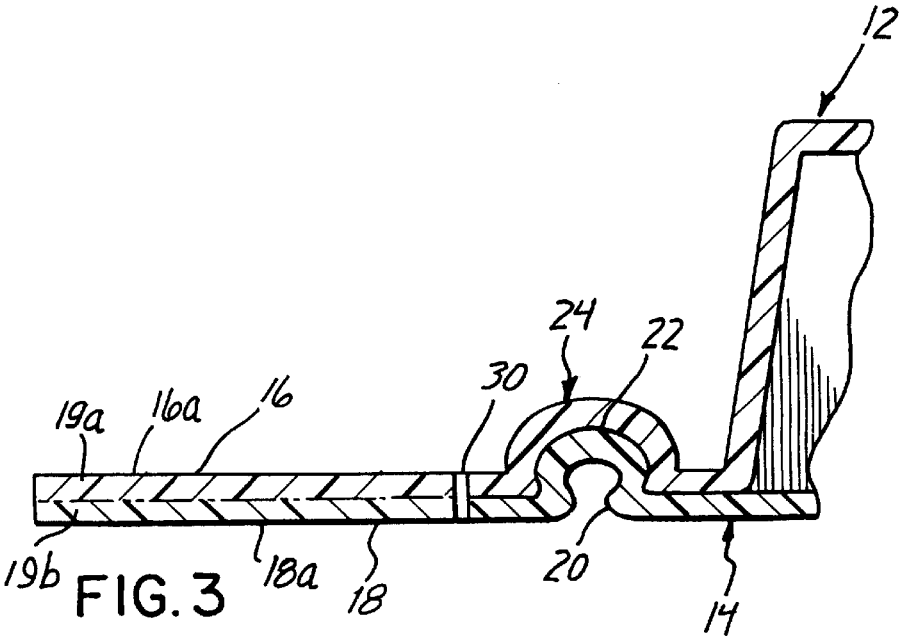
FIG. 3 is a cross sectional view taken along line 3—3 of FIG. 2.

A first embodiment of the invention is illustrated in FIGS. 1–4. In this embodiment, a clamshell package 10 includes first and second clamshell members or halves 12, 14 each with respective three dimensionally shaped pocket areas 12*a*, 14*a* for receiving a product (not shown). Preferably, clamshell members 12, 14 are formed from completely transparent plastic, such as polyvinylchloride (PVC). First and second clamshell members 12, 14 include respective flanges 16, 18 that are preferably heat sealed, ultrasonically sealed or adhesively sealed together in a permanent manner. Peripherally inside of flanges 16, 18, a selectively engageable fastening structure 24 is provided and, as one of many possibilities, comprises a bead 20 contained with a snap-fit or frictional fit within a recess 22, as best shown in FIG. 3. A hinge portion 28 comprises another sealing area and a plurality of sets of perforations 30, 32, 34 are disposed respectively between sealing areas 19, 28 and 35 and the selectively engageable fastening structures 24, 26.

As shown in FIG. 1, sealing area 19 comprises a first sealing portion 19*a* on clamshell member 12 and a second sealing portion 19*b* on clamshell member 14, wherein the sealing portions 19*a*, 19*b* have a substantially confronting relationship. Sealing area 28 comprises a first sealing portion 28*a* on clamshell member 12 and a second sealing portion 28*b* on clamshell member 14, wherein the sealing portions 28*a*, 28*b* have a substantially confronting relationship. Sealing area 35 comprises a first sealing portion 35*a* on clamshell member 12 and a second sealing portion 35*b* on clamshell member 14, wherein the sealing portions 35*a*, 35*b* have a substantially confronting relationship. Sealing portions 19*a*, 28*a* and 35*a* are located near respective peripheral edges 16*a*, 16*b* and 16*c* of flange 16 on clamshell member 12. Sealing portions 19*b*, 28*b* and 35*b* are located near respective peripheral edges 18*a*, 18*b*, and 18*c* of flange 18 on clamshell member 14.

Figure 4:
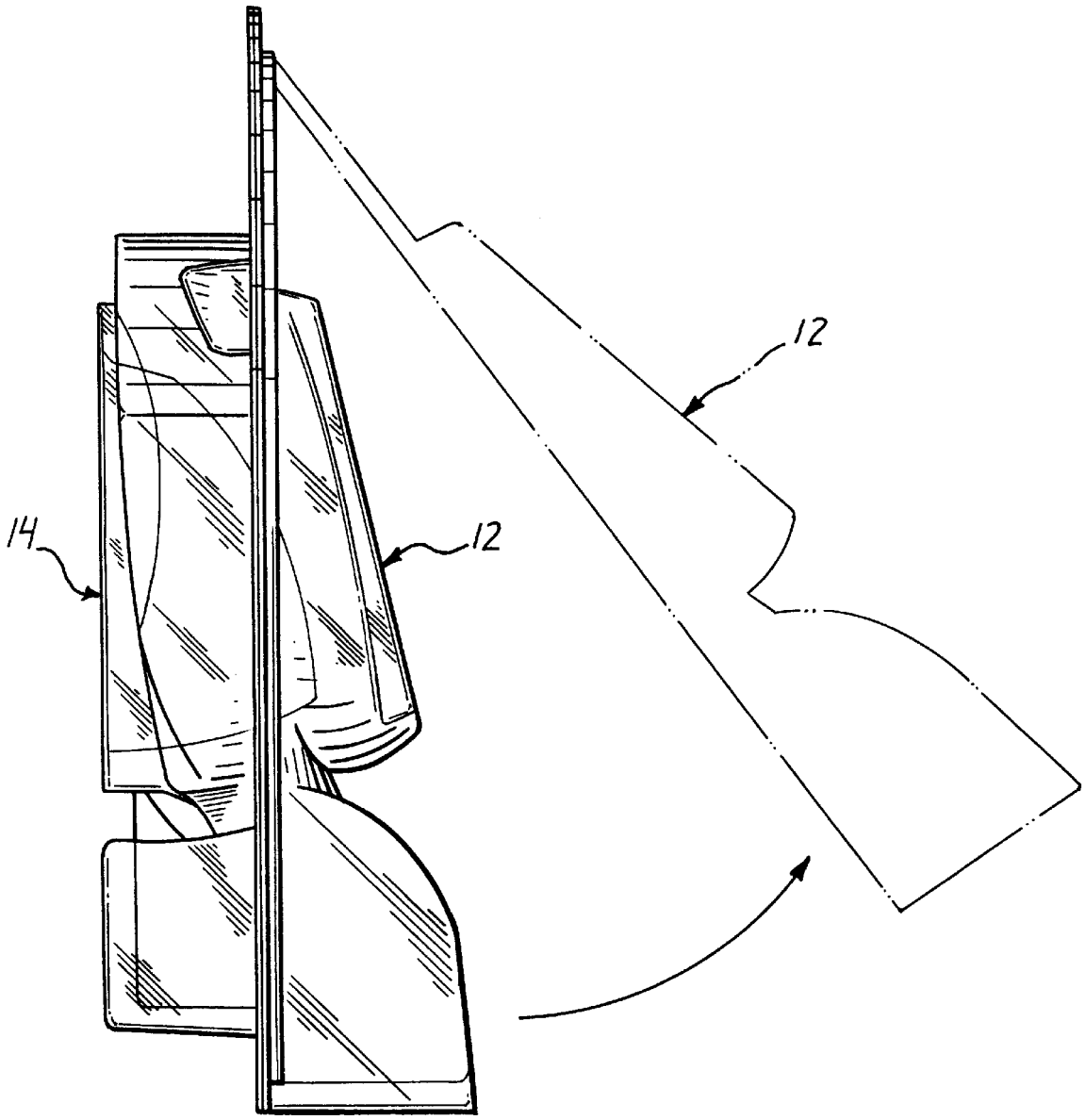
FIG. 4 is a side elevational view of the embodiment shown in FIG. 1 schematically illustrating the hinged opening and closing capability.

As best illustrated in FIG. 2, a consumer may use a pair of scissors 36, or another cutting method, to remove sealing areas 19, 28 and 35 by cutting along perforations 30, 32 and 34. Alternatively, one of the sealing areas 19, 28, 35 may be left intact, such as sealing area 28, to provide a hinge portion for allowing selective opening and closing of clamshell package 10, as shown in FIG. 4. In this case, the lower edge of clamshell package 10 between clamshell members 12, 14 may be left unsealed during packaging such that it may be opened as shown in FIG. 4. Alternatively, the lower edge may likewise include a sealing area which may be cut off or otherwise removed in a manner similar to the other sealing areas shown in FIG. 1.

As further shown in FIG. 1, clamshell member 12 may include one or more feet 38, 40 for allowing clamshell package 10 to freely stand in an upright position as shown for display purposes. As an alternative manner of displaying clamshell package 10, an aperture 42 may be provided for receiving a display hook. A lower edge 44 formed at the bottom of clamshell members 12, 14 may provide additional support for allowing package 10 to be free-standing.

Figure 5:
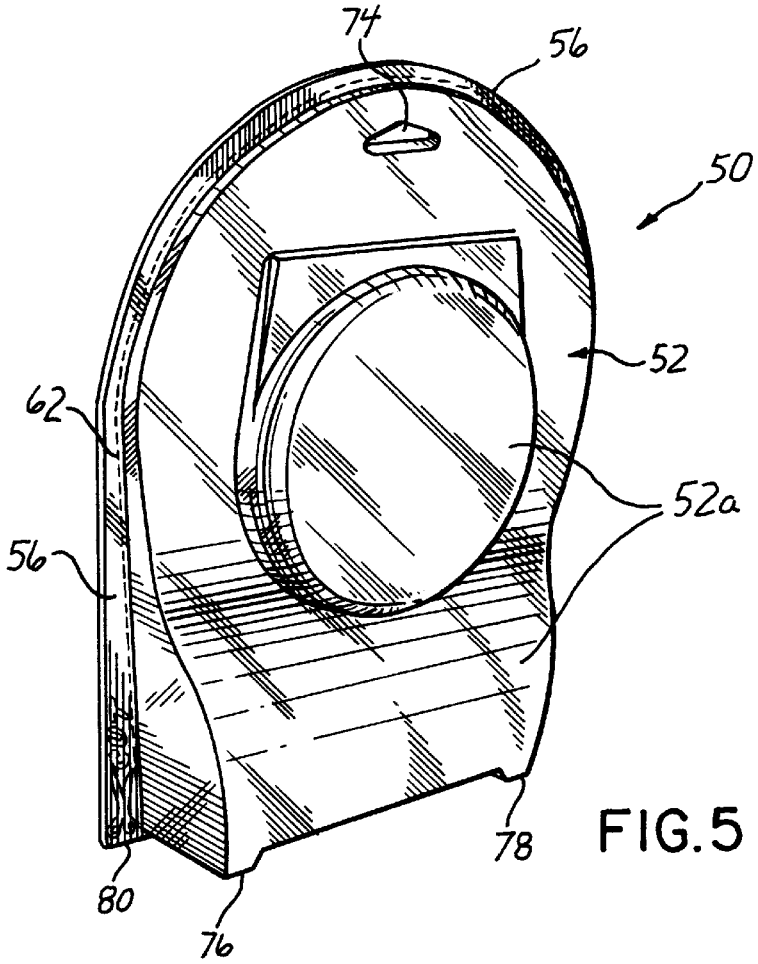
FIG. 5 is a perspective view of a clamshell package constructed in accordance with another embodiment of the invention.
Figure 6:
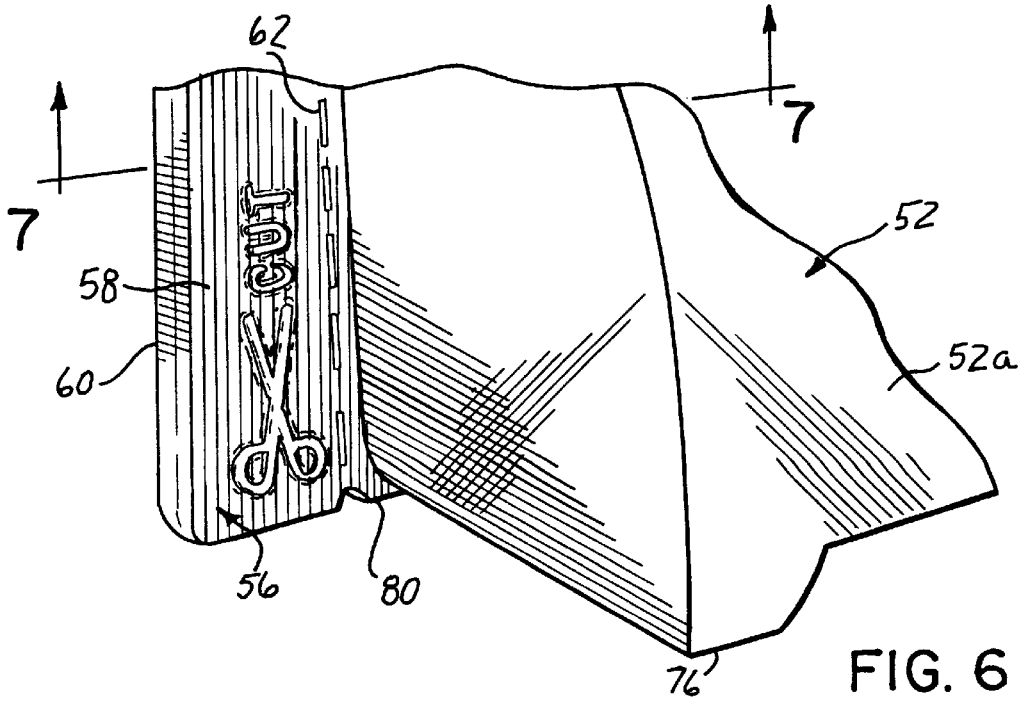
FIG. 6 is an enlarged, fragmented view of a lower corner of the clamshell package shown in FIG. 5.
Figure 7:
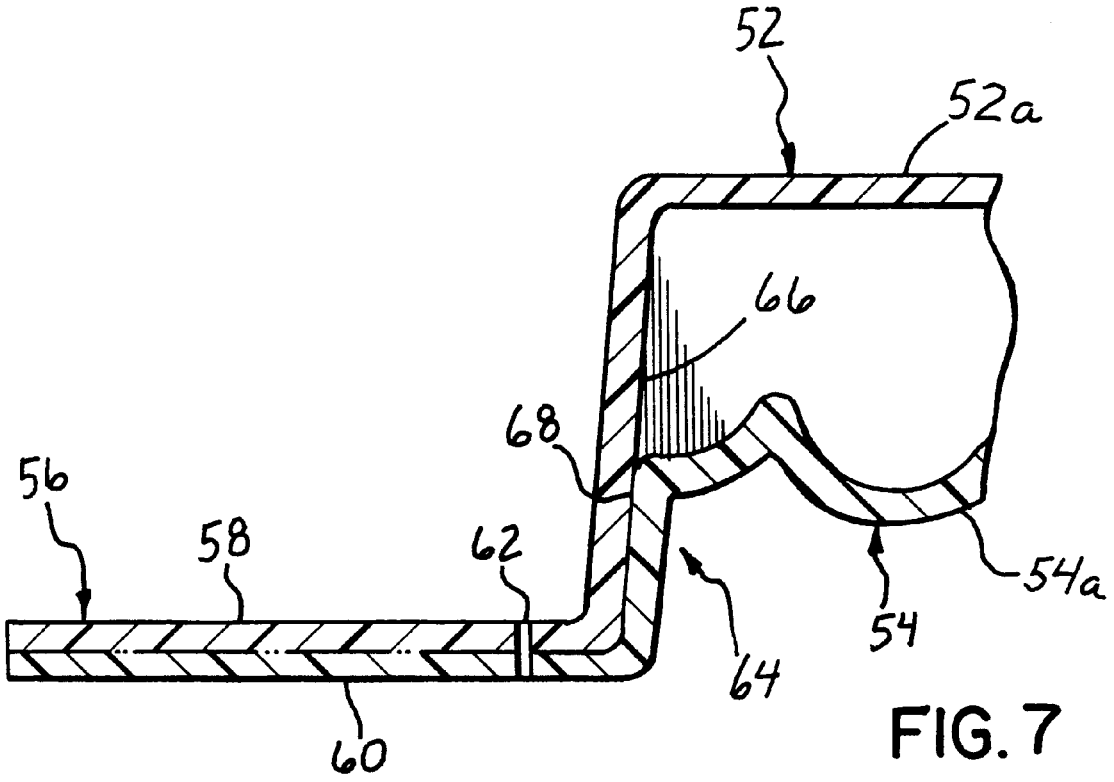
FIG. 7 is a cross sectional view taken along line 7—7 of FIG. 6.

A second embodiment of the invention is shown in FIGS. 5–7. In this embodiment, a clamshell package 50 again includes first and second clamshell members 52, 54, which are each preferably transparent as in the first embodiment. Each of the first and second clamshell members 52, 54 includes a three dimensionally shaped pocket area 52*a*, 54*a*. Unlike the first embodiment, a continuous sealing area 56 is provided at least substantially around the entire periphery of package 50. Preferably, sealing area 56 is formed as a continuous flange. Although not shown in the drawings, this sealing area may also be extended along the bottom edge of package 50. Sealing area 56 is preferably comprised of respective sealing portions or flanges 58, 60 of the clamshell members 52, 54. A line of continuous perforations is provided peripherally inside of sealing area 56 for providing a cutting indicator line for the consumer or other user.

As further shown in FIG. 7, selectively engageable fastening structure 64 is provided peripherally inside of perforations 62 such that, when sealing area 56 has been cut off or otherwise removed by the user, first and second clamshell members 52, 54 may be selectively engaged and disengaged with respect to one another to provide selective access to the product (not shown) contained therein. In this embodiment, selectively engageable fastening structure 64 simply comprises a nesting structure in which an inner surface 66 of clamshell member 52 engages an outer surface 68 of clamshell member 54 such that clamshell member 54 nests within a portion of clamshell member 52. As will be further understood from FIG. 7, when sealing area 56 is removed by cutting along perforations 62, clamshell members 52, 54 may be engaged and disengaged with a frictional fit.

Referring again to FIG. 5, as with the first embodiment, a hook aperture 74 may be provided in an upper portion of package 50 and a pair of feet 76, 78 may be provided on one of the clamshell members, such as clamshell member 52, to allow package 50 to be a free-standing structure. Again, a lower edge 80 may additionally be provided to lend additional support for the upstanding package 50.

While the present invention has been illustrated by a description of the preferred embodiments and while these embodiments have been described in some detail, it is not the intention of the Applicant to restrict or in any way limit the scope of the appended claims to such detail. Additional advantages and modifications will readily appear to those skilled in the art. This has been a description of the present invention, along with the preferred methods of practicing the present invention as currently known. Various aspects of this invention may be used alone or in different combinations. The scope of the invention itself should only be defined by the appended claims, wherein I claim:

What is claimed is:

1. A clamshell package for holding and displaying a product, the package comprising:

a first outer clamshell member comprising a first outer peripheral edge, a second outer peripheral edge, a first three dimensional pocket area for holding a portion of the product, a first removable sealing portion adjacent said first outer peripheral edge, and a second removable sealing portion adjacent said second outer peripheral edge, a second outer clamshell member comprising a third outer peripheral edge, a fourth outer peripheral edge, a second three dimensional pocket area for holding another portion of the product, a third removable sealing portion adjacent said third outer peripheral edge, and a fourth removable sealing portion adjacent said fourth outer peripheral edge, said third and fourth removable sealing portions adapted to be respectively sealed to said first and second removable sealing portions, and selectively engageable fastening structure disposed on the first outer clamshell member between said first and second removable sealing portions and on the second outer clamshell member between said third and fourth removeable sealing portions, said first, second, third and fourth removable sealing portions being disposed with respect to said fastening structure such that, when said removable sealing portions are removed, said fastening structure may be engaged and disengaged to allow selective access to the product.

2. The clamshell package of claim 1, wherein said first and second sealing portions are heat sealed together.

3. The clamshell package of claim 1, wherein said first and second sealing portions are adhesively secured together.

4. The clamshell package of claim 1, wherein said selectively engageable fastening structure further comprises at least one bead disposed along a peripheral portion of one of said first and second outer clamshell members and at least one mating recess disposed along a corresponding peripheral portion of the other of said first and second outer clamshell members.

5. The clamshell package of claim 4 further comprising plural said beads disposed about respective peripheral portions of said one outer clamshell member and corresponding plural said mating recesses disposed about respective peripheral portions of said other outer clamshell member.

6. The clamshell package of claim 1 further including a hinge portion connecting respective peripheral portions of said first and second outer clamshell members to allow selective opening and closing of said clamshells along said hinge portion by disengaging and engaging said fastening structure.

7. The clamshell package of claim 6, wherein said first clamshell member further comprises a fifth outer peripheral edge and a fifth removable sealing portion adjacent said fifth outer peripheral edge, and said second clamshell member further comprises a sixth outer peripheral edge and a sixth removable sealing portion adjacent said sixth outer peripheral edge, said hinge portion formed at least in part by the fifth and sixth removable sealing portions of said first and second outer clamshell members.

8. The clamshell package of claim 7, wherein said hinge portion is disposed along an upper peripheral portion of said first and second outer clamshell members.

9. The clamshell package of claim 7 further comprising a series of perforations generally extending adjacent said first, second, third, fourth, fifth and sixth removable sealing portions to provide a cutting indicator line for selectively removing said first, second, third, fourth, fifth and sixth removable sealing portions.

10. The clamshell package of claim 7, wherein the first, second, third and fourth removable sealing portions may be removed leaving the hinge portion in place.

11. The clamshell package of claim 1, wherein the selectively engageable fastening structure further comprises respective inner and outer surfaces of said first and second outer clamshell members, said inner and outer surfaces nesting together in a selectively engageable manner.

12. The clamshell package of claim 1 further comprising a lower surface on at least one of said first and second outer clamshell members, said lower surface including support structure allowing the first and second outer clamshell members to be free-standing when secured together with a product contained therein.

13. The clamshell package of claim 1, wherein said first, second, third, fourth, fifth and sixth removable sealing portions are disposed peripherally outside of said fastening structure.

14. A clamshell package for holding and displaying a product, the package comprising:

a first outer clamshell member comprising a first outer peripheral edge, a second outer peripheral edge, a first three dimensional pocket area for holding a portion of the product, a first removable sealing portion adjacent said first outer peripheral edge and a second removable sealing portion adjacent said second outer peripheral edge, a second outer clamshell member comprising a third outer peripheral edge, a fourth outer peripheral edge, a second three dimensional pocket area for holding another portion of the product, a third removable sealing portion adjacent said third outer peripheral edge, and a fourth removable sealing portion adjacent said fourth outer peripheral edge, said third and fourth removable sealing portions adapted to be respectively sealed to said first and second removable sealing portions, selectively engageable fastening structure disposed on the first outer clamshell member between said first and second removable sealing portions and on the second outer clamshell member between said third and fourth removeable sealing portions, said first, second, third and fourth removable sealing portions being disposed with respect to said fastening structure such that, when said removable sealing portions are removed, said fastening structure may be engaged and disengaged to allow selective access to the product, and a cutting indicator line disposed adjacent at least one of the first, second, third and fourth removable sealing portions for indicating where a cut may be made to remove said one of the sealing portions after sealing thereof.

15. The clamshell package of claim 14, wherein said first and second sealing portions are heat sealed together.

16. The clamshell package of claim 14, wherein said first and second sealing portions are adhesively secured together.

17. The clamshell package of claim 14, wherein said selectively engageable fastening structure further comprises at least one bead disposed along a peripheral portion of one of said first and second outer clamshell members and at least one mating recess disposed along a corresponding peripheral portion of the other of said first and second outer clamshell members.

18. The clamshell package of claim 17 further comprising plural said beads disposed about respective peripheral portions of said one outer clamshell member and corresponding plural said mating recesses disposed about respective peripheral portions of said other outer clamshell member.

19. The clamshell package of claim 14 further including a hinge portion connecting respective peripheral portions of said first and second outer clamshell members to allow selective opening and closing of said clamshells along said hinge portion by disengaging and engaging said fastening structure.

20. The clamshell package of claim 19, wherein said first clamshell member further comprises a fifth outer peripheral edge and a fifth removable sealing portion adjacent said fifth outer peripheral edge, and said second clamshell member further comprises a sixth outer peripheral edge and a sixth removable sealing portion adjacent said sixth outer peripheral edge, said hinge portion formed at least in part by the fifth and sixth removable sealing portions of said first and second outer clamshell members.

21. The clamshell package of claim 20, wherein said hinge portion is disposed along an upper peripheral portion of said first and second outer clamshell members.

22. The clamshell package of claim 19, wherein the first, second, third and fourth removable sealing portions may be removed leaving the hinge portion in place.

23. The clamshell package of claim 14, wherein said cutting indicator line further comprises a series of perforations.

24. The clamshell package of claim 14, wherein said fastening structure further comprises respective inner and outer surfaces of said first and second outer clamshell members, said inner and outer surfaces nesting together in a selectively engageable manner.

25. The clamshell package of claim 14 further comprising a lower surface on at least one of said first and second outer clamshell members, said lower surface including support structure allowing the first and second outer clamshell members to be free-standing when secured together with a product contained therein.

26. The clamshell package of claim 14, wherein said first, second, third, and fourth removable sealing portions are disposed peripherally outside of said fastening structure.

* * * * *